United States Patent [19]

Turpie et al.

[11] 4,090,277

[45] * May 23, 1978

[54] TEXTILE FIBRE COMBING

[75] Inventors: Derek William Fraser Turpie; Jaroslav Klazar, both of Port Elizabeth, South Africa

[73] Assignee: South African Inventions Development Corp., Pretoria, South Africa

[ * ] Notice: The portion of the term of this patent subsequent to Jul. 27, 1993, has been disclaimed.

[21] Appl. No.: 657,530

[22] Filed: Feb. 12, 1976

[30] Foreign Application Priority Data

Feb. 13, 1975 South Africa ..... 75/0926

[51] Int. Cl.[2] ..... D01G 19/10

[52] U.S. Cl. ..... 19/115 R; 19/125

[58] Field of Search ..... 19/11, 12, 13, 115 R, 19/122, 126, 128, 125, 215

[56] References Cited

U.S. PATENT DOCUMENTS

| | | | |
|---|---|---|---|
| 122,678 | 1/1872 | Tavernier | 19/122 |
| 2,039,085 | 4/1936 | Kinker, Jr. | 19/12 X |
| 3,718,944 | 3/1973 | Clark | 19/123 |
| 3,971,104 | 7/1976 | Turpie et al. | 19/115 R |

FOREIGN PATENT DOCUMENTS

| | | | |
|---|---|---|---|
| 184,102 | 12/1955 | Austria | 19/122 |
| 814 of | 1855 | United Kingdom | 19/11 |
| 1,591 of | 1854 | United Kingdom | 19/11 |

*Primary Examiner*—Dorsey Newton

*Attorney, Agent, or Firm*—Irvin A. Lavine

[57] ABSTRACT

Apparatus for advancing slivers of textile or the like fibres through all stages of a combing operation in which a track is provided, in which track an endless element such as a chain is movable, the element providing an anchorage for a plurality of combing units adapted to carry the slivers, and the track including at least one linear section. The linear section of the track carries combing components so that the combing operations on the sliver are carried out substantially while the sliver is transported past the linear section of the track.

7 Claims, 2 Drawing Figures

TEXTILE FIBRE COMBING

Figure 1:
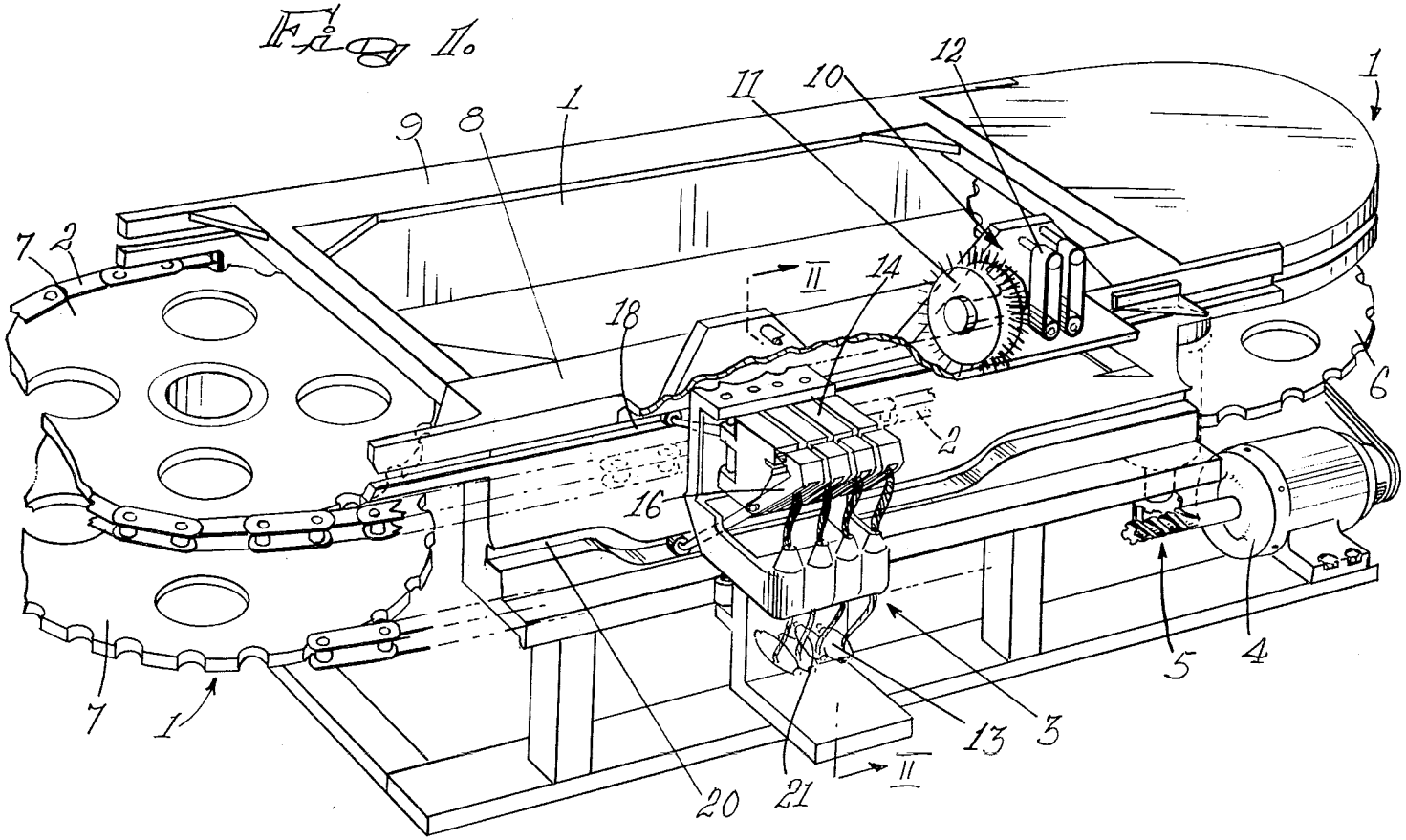

This invention relates to or is for improvements in textile fibre combing.

Textile fibers are combed to remove short fibres, neps, vegetable and other impurities. The two most commonly used machines for combing fibres are the rectilinear combing machine and the Noble combing machine. Recently certain combinations of these machines have been proposed to incorporate the advantages of both machines into a single machine. However, certain disadvantages of both machines have remained or have not been solved by these proposals. For example, in all Noble comb type arrangements there is an inherent limitation on the number of operations that can be performed in a single revolution due to the fact that the diameter of the mechanism cannot be indefinitely enlarged. Furthermore even relatively small increases in the diameter of the Noble comb arrangement make the comb awkward to operate since some mechanisms become inaccessible from outside the ring of combs.

The disadvantage of non-enlargement applies also to rectilinear combing machines since the width of the comb and the nipper jaws or clamps cannot be extended without introducing structural weaknesses and making the clamping mechanism less effective.

It is accordingly an object of the present invention to provide apparatus for advancing a sliver of textile or like fibres through all stages of a combing operation and also combing apparatus incorporating such advancing apparatus which, while incorporating features of combing used in the rectilinear machine and the Noble machine, includes advantages which the applicant believes will be useful.

According to the invention apparatus for advancing a sliver of textile or the like fibres through all stages of a combing operation includes a track, an endless element such as a chain or the like movable in the track, the element being adapted to act as an anchorage for a combing unit, and the track including at least one linear section, wherein combing of the sliver is effected.

Preferably the track includes two linear substantially parallel sections with two sections at the ends thereof to provide paths for the element from the one linear section to the other. In this way additional lengths of linear track and of the element, and additional comb units as well as other components of the apparatus may be incorporated. Furthermore all the components of the apparatus will be readily accessible due to the configuration of the track.

In this arrangement the parallel sections of the track are preferably located close to each other to form an apparatus of narrow elongated shape. The width of the apparatus (from linear section to linear section) is preferably such that an operator of the apparatus could easily reach the centre of the apparations from one side or the other thereof.

In a preferred embodiment, the plane which the track defines is substantially horizontal but in other embodiments the plane may be at any suitable angle.

With the arrangement according to the invention it will be possible to associate any suitable number of combs, fibre drawing off mechanisms and other components normally associated with textile combing apparatus, with the track.

Thus by suitably arranging the movement of the endless element and the combing unit in the track the number of combing and drawing off operations that can be done in, say, a single revolution of a combing unit around the track can be easily and suitably chosen.

Preferably the combing unit includes a reservoir for slivers, a feed mechanism for drawing slivers from the reservoir and feeding them into a position suitable for combing, nipper elements for holding slivers during combing operations and pinned elements for combing and/or gilling the slivers. In gilling, pinned elements engage the fibres to align them; in combing the pinned elements engage the fibres to separate long fibres from short fibres.

Also according to the invention the pinned elements are adapted to be movable relative to the anchorage chain in addition to being movable with the chain in the track. In this way the pinned elements may act as a sliver feed mechanism as well as performing its normal combing or gilling operation.

The invention also contemplates combing apparatus incorporating the advancing means described above. The combing apparatus thus includes clamping means, fibre combing means, and means for removing combed fibres from the combed sliver, these means being all preferably located adjacent the track and arranged so that the combing unit moves past them. The reservoir for storing sliver, laps or the like of fibres, such as creels, are preferably included in the combing apparatus and arranged to move on the track with the combing unit, past the stationary elements described above. Such a creel and associated pinned elements may comprise a single mobile combing unit and in a preferred embodiment of the invention the combing apparatus includes a plurality of such units moving in the track.

The combing apparatus may also include a plurality of stationary units including fibre combing means, drawing off means and means to convey the combed fibres to a suitable disposal point.

Further features of the invention will be illustrated in the description hereunder which is given as an example.

Figure 2:
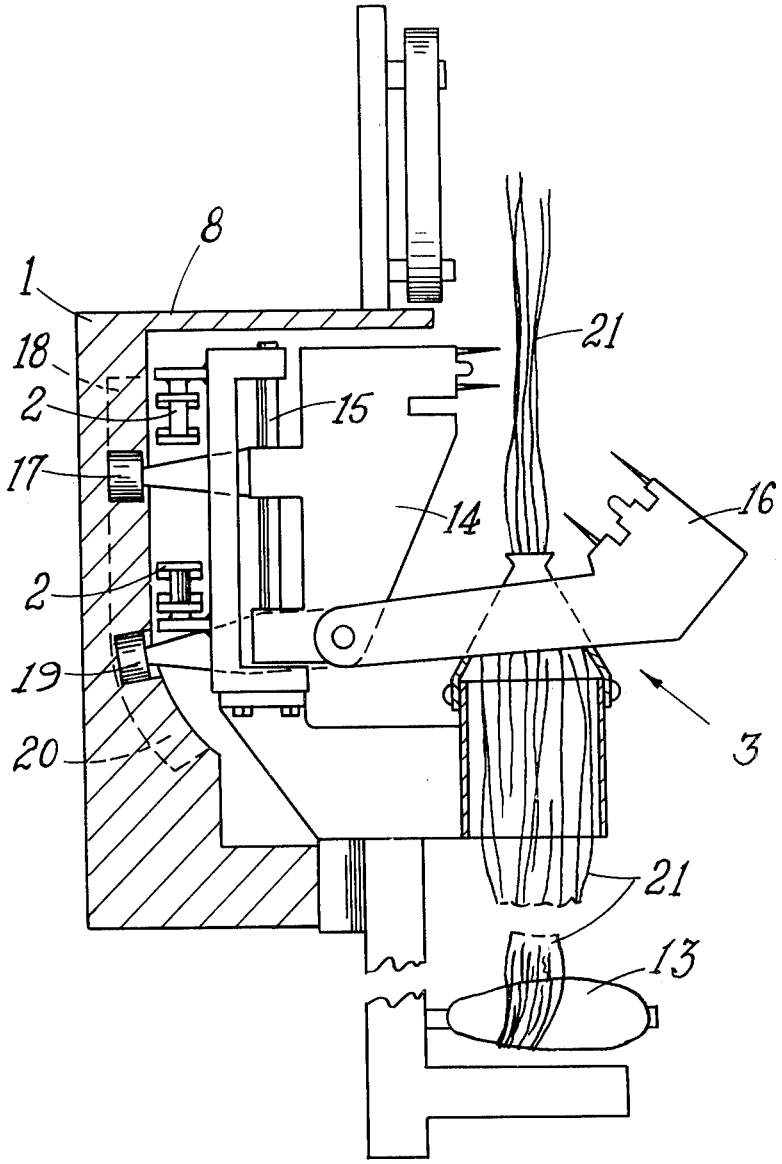

The description is with reference to the drawings in which:

FIG. 1 is a schematic diagram in perspective view of apparatus according to the invention with parts cut out, FIG. 2 is a section along line II—II of FIG. 1 but showing the comb element in the open position.

Referring to FIG. 1 the textile fibre combing apparatus comprises a track 1 and an endless chain 2 movable in the track. The chain is linked to combing units 3 (of which only one is shown in the drawing for the sake of clarity), the chain providing an anchorage or support for the combing units. With this arrangement the combing units move around the track with the chain. The chain is driven by means of an electric motor 4 or the like linked by suitable gearing means 5 to a sprocket wheel.. A complementary free running sprocket wheel 7 is provided at the other end of the apparatus to complete a path for the chain from one linear sections 8 of the track to a second linear section 9. The two linear sections are substantially parallel. The arrangement is such that substantially all the combing operations are carried out during the combing units travel along the linear sections of the track. For this purpose, what may be termed combing heads 10 are strategically located on the track in its linear section. All the components of the combing heads are not shown since they do not strictly form part of the invention. The combing heads may comprise standard combing components such as one or more rotary combs of the type indicated by numeral 11, and drawing off rollers indicated at 12. Other components generally used with combing apparatus may also be included such as top combs, nipper jaws and lifting knives. These are well known in the art as can be seen by reference to U.S. Pat. No. 3,718,944 in the name of Clark and U.S. Pat. No 3,445,896 Chaiken et el.

The combing units 3 includes creels 13 which are adapted to hold slivers or laps of fibres 21 which may be drawn off the creels and fed upwards towards combing zones. These creels, integral with the combing units, are therefore carried round the track with the combing unit at the same linear speed. The combing units further include a pinned carriage 14 which is slidably movable along carriage guides 15 and a further pinned segment 16 which is pivotally linked to the carriage 14. The movement of the carriage 14 is controlled by means of a cam 17 running in a guide 18 and the movement of the segment 16 is likewise controlled by means of a cam 19 running in guide 20. By suitably arranging the cams and guides pinned members 14 and 16 can be made to close on the sliver 21 at an appropriate stage and then to be moved while so clamped transversely of the chain 2, such as in a vertical plane as shown in FIG. 2 to thereby feed the sliver by pulling it from the creel 13 and also at another stage hold or clamps the sliver, for example, during combing of its fringe end by rotary comb 11. The pinned members may also perform a combing operation on the tails of certain of the sliver fibres as they are being withdrawn from the sliver by the rollers 12.

The apparatus may comprise any suitable number of combing heads 10 which can be located within the space of any linear section of the track and may also comprise any suitable number of combing units 2. In this way a multiple-head combing machine may be formed.

Furthermore it is contemplated that linear sections of the track may be manufactured as an integral unit and that these units be adapted to be able to be linked together in modular form, to form an elongated combing apparatus. In this form of the invention the chain is extended to accommodate the extra linear units and extra combing units anchored to the chain to increase the capacity of the apparatus. The width of the linear units is chosen such that an operator may easily reach to the centre line of the unit to enable him to carry out any operations that may be necessary such as cleaning or aligning of drawn off fibres etc.

It will be appreciated that the form of the combing heads 10 is not limited to the particular configuration described above. In fact any suitable combing heads or combination of combing and drawing off elements may be used, the essence of the invention being the facility to add any suitable number of combing heads along the linear sections of the track, and to lengthen the track to any suitable length by adding linear units as described above, with space available, and to also correspondingly add a suitable number of combing units to the chain.

Thus it will be seen that many variations in detail are possible, but these are envisaged as falling within the scope of this disclosure.

We claim:

1. Apparatus adapted to advance a sliver of textile or the like fibres through at least some of a combing operation including:

a track forming an endless path and having at least one linear section, an endless flexible support element carried by and movable along the track, means for driving said support element, at least one combing unit secured to said endless flexible support element for movement therewith, said combing unit comprising plural combing elements and means mounting at least one said combing element for movement relative to the other said combing element, guide means extending along said path at said linear section, said guide means and said combing unit comprising cooperating means for causing movement of said movable combing element relative to said other said combing element as said combing unit is moved by said endless element.

2. The apparatus claimed in claim 1 wherein the track includes two substantially linear parallel sections, with two sections at the ends thereof to provide paths for the endless element from the one linear section to the other.

3. The apparatus claimed in claim 2 wherein the linear sections of the track are located close to each other to enable an operator of the apparatus to reach a centre line between the linear sections.

4. Apparatus as claimed in claim 1 wherein the plane which the track defines is substantially horizontal.

5. The apparatus claimed in claim 1 including a stationary combing head located adjacent the track and arranged so that the combing unit moves past it, the combing head including clamping means, fibre combing means, and means for removing combed fibres from a combed sliver.

6. The apparatus claimed in claim 1, said guide means and combing unit further comprising cooperating means for guiding said combing unit for causing said combing unit to pull sliver from a reservoir for slivers carried by said combing unit.

7. The apparatus claimed in claim 1, wherein there are two parallel linear sections of track joined and providing a unitary construction.

* * * * *